US010841997B2

(12) United States Patent
Hegde et al.

(10) Patent No.: US 10,841,997 B2
(45) Date of Patent: Nov. 17, 2020

(54) METHOD OF CONTROL OF POWER SUPPLY FOR SOLID-STATE LAMP

(71) Applicant: Ledvance LLC, Wilmington, MA (US)

(72) Inventors: Ravidasa Hegde, Andover, MA (US); Arunava Dutta, Winchester, MA (US); Janet A. Milliez, Cambridge, MA (US); Jason J. Li, Boxford, MA (US)

(73) Assignee: LEDVANCE LLC, Wilmington, MA (US)

( * ) Notice: Subject to any disclaimer, the term of this patent is extended or adjusted under 35 U.S.C. 154(b) by 338 days.

(21) Appl. No.: 15/702,899

(22) Filed: Sep. 13, 2017

(65) Prior Publication Data

US 2018/0227991 A1 Aug. 9, 2018

Related U.S. Application Data

(63) Continuation-in-part of application No. 15/424,135, filed on Feb. 3, 2017, now Pat. No. 10,683,990.

(60) Provisional application No. 62/527,197, filed on Jun. 30, 2017.

(51) Int. Cl.

| | |
|---|---|
| ***H05B 33/08*** | (2020.01) |
| ***H05B 45/37*** | (2020.01) |
| ***F21K 9/232*** | (2016.01) |
| ***F21K 9/278*** | (2016.01) |
| ***F21K 9/238*** | (2016.01) |
| ***F21V 23/00*** | (2015.01) |
| ***F21K 9/64*** | (2016.01) |
| ***F21V 23/04*** | (2006.01) |
| ***H05B 45/20*** | (2020.01) |
| *F21Y 115/10* | (2016.01) |
| *F21Y 113/13* | (2016.01) |

(52) U.S. Cl.

CPC ..... *H05B 45/37* (2020.01); *F21K 9/232* (2016.08); *F21K 9/238* (2016.08); *F21K 9/278* (2016.08); *F21K 9/64* (2016.08); *F21V 23/005* (2013.01); *F21V 23/04* (2013.01); *H05B 45/20* (2020.01); *F21V 23/006* (2013.01); *F21Y 2113/13* (2016.08); *F21Y 2115/10* (2016.08)

(58) Field of Classification Search

CPC ..... H05B 33/0815; H05B 33/0845; H05B 33/0857; H05B 33/0863

USPC ..... 315/307, 312

See application file for complete search history.

(56) References Cited

U.S. PATENT DOCUMENTS 7,161,311 B2 * 1/2007 Mueller ..... G09G 3/2014 315/294

2009/0160627 A1 * 6/2009 Godbole ..... H05B 45/37 340/12.33

(Continued)

*Primary Examiner* — Tung X Le

(74) *Attorney, Agent, or Firm* — Hayes Soloway PC

(57) ABSTRACT

A light emitting element control circuit and power supply for a solid state lamp includes an electrical control circuit controller which enables the operation of a solid state lamp in three distinct modes, which allows the user significant flexibility in operation of the lamp. It enables the user to operate the lamp with a fixed emission spectrum but with intensity control (Mode I); or with discrete settings of blue only or red only or a fixed ratio of the two (Mode II); or an on-demand ratio of blue to red emission whereby the user can operate the lamp with any arbitrary ratio of blue to red for example to meet different spectral requirements of, for example, different phases of plant growth (Mode III).

27 Claims, 10 Drawing Sheets

(56) References Cited

U.S. PATENT DOCUMENTS

| | | | | |
|---|---|---|---|---|
| 2013/0141013 | A1* | 6/2013 | Kodama | F21K 9/64 315/294 |
| 2014/0159596 | A1* | 6/2014 | Sutardja | H05B 33/0827 315/192 |
| 2014/0312777 | A1* | 10/2014 | Shearer | H05B 33/0869 315/151 |
| 2016/0278176 | A1* | 9/2016 | Chen | H05B 39/044 |
| 2017/0162547 | A1* | 6/2017 | Bergmann | H05B 33/0803 |
| 2017/0238392 | A1* | 8/2017 | Shearer | H05B 33/0854 315/153 |

* cited by examiner

METHOD OF CONTROL OF POWER SUPPLY FOR SOLID-STATE LAMP

CROSS-REFERENCE TO RELATED APPLICATIONS

The present disclosure relates to solid-state lighting (SSL) and more particularly to a method of controlling a power supply for light-emitting diode (LED)-based lamps. This application is a continuation-in-part of pending U.S. patent application Ser. No. 15/424,135 filed Feb. 3, 2017 and entitled SOLID-STATE HORTICULTURAL LAMP. This application is related to and claims the benefit of U.S. Provisional Patent Application No. 62/527,197 entitled METHOD OF CONTROL OF POWER SUPPLY FOR SOLID-STATE LAMP, filed on Jun. 30, 2017 and fully incorporated herein by reference.

TECHNICAL FIELD

The present disclosure relates to solid-state lighting (SSL) and more particularly to a method of controlling a power supply for light-emitting diode (LED)-based lamps.

BACKGROUND INFORMATION

As a branch of agriculture, horticulture encompasses the science and art pertaining to cultivating edible, medicinal, and ornamental plants and fungi. Generally, horticulture impacts one's daily life by providing fruits and vegetables suitable for consumption, flowers and vegetation that provide visual and other sensory enjoyment, components for medicines, and promoting recreational activities.

Horticulture has been an integral part of human society for a very long time. From a residential perspective, or the culture serves to satisfy the aesthetic cravings of the human mind to see beautiful foliage and flowers with a wide gamut of colors. It also addresses the desire of many people to grow delicious vegetables and fruits for consumption. From a commercial viewpoint, the strong need to feed the growing population of the world through commercial farming of plants and vegetables is an issue of global proportions and even national security. Furthermore, the farming of special plants for medicinal purposes is taking on an ever-increasing importance, particularly in the US.

In nature, sunlight is the primary source of light for plant growth. The photons in the visible spectrum of sunlight that range in wavelength from about 400-700 nm stimulate pigments (e.g., chlorophyll A and chlorophyll B) in plants. This is necessary for optimum photosynthesis in plants, which leads to the production of vital sugars in the presence of carbon dioxide ($CO_2$) and water ($H_2O$). Without photosynthesis, there cannot be plant growth, and thus light is essential for the growth of plants.

Numerous incandescent, high-intensity discharge (HID), and fluorescent lighting sources for plant growth exist. However, each of these existing artificial lighting options is not without significant drawbacks. For instance, incandescent sources are very energy inefficient (i.e. a very small portion of the input electrical energy is converted into visible photons) and generate a Lot of undesirable heat, requiring them to be sufficiently distanced from the plants to avoid plant damage, which further lowers their effectiveness. HID lamp sources also generate heat and are deficient in the blue portion (400-500 nm) of the spectrum that typically stimulates chlorophyll B pigments in the plant, which is particularly important for photosynthesis in young plants, and helps with $CO_2$ gas exchange. Although fluorescent sources generate less undesirable heat than incandescent and HID sources, they contain the hazardous material Mercury, and thus use of fluorescent sources near plants and disposal of such sources is an issue.

A further concern, the spectral power distribution (SPD) of a horticultural lamp plays a major part in the effectiveness of the photosynthesis process, which is keyed to plant growth. The shape of the lamp spectrum over the different wavelengths, the relative intensity of the SPD at different wavelengths, and the relative spectral power in the blue, green, and red regions of the spectrum are all important parameters that influence the development of plants over their growth cycle. The SPD of the horticultural lamp is created by the emission of the LEDs which in turn are driven by electronics in the form of a power supply located in the lamp.

Accordingly, what is needed is a power supply for an LED or other solid state horticultural lamp which may be user controlled and is configured to operate the lamp in one or more modes including a fixed emission spectrum with intensity control; with discrete settings of blue only, red only or a user selectable fixed ratio of the two spectrums; and lastly a mode whereby the user can selectively operate the lamp with any arbitrary ratio of blue to red to meet different spectral requirements for different phases of plant growth.

SUMMARY

The power supply described and claimed in this invention enables the operation of a horticultural lamp in three distinct modes, which allows the user significant flexibility in operation of the lamp. The present invention enables the user, in a first embodiment, to operate the lamp with a fixed emission spectrum but with intensity control (Mode I). In a second embodiment, the present invention also allows the user to operate the lamp with discrete settings of blue only or red only or a fixed ratio of the two (Mode II). Finally, 1/3 embodiment of the invention allows the user to have an on-demand control of the ratio of blue to red emission such that the user can operate the lamp with any arbitrary ratio of blue to red for example to meet different spectral requirements for different phases of plant growth. This improves the yield and quality of the plants and vegetables.

It is the goal of this application to describe different ways of driving the LED strings in a horticultural lamp. The three embodiments disclosed and claimed in the present application include:

Mode I: The ability of a lamp to produce a fixed emission spectrum but enabling the user to be able to change the intensity of emission from 50% to 100%; here the light engine would have one string of LED's, either emitting in the blue-green portion of the spectrum (400-500 nm blue and 500-600 nm green) or in the red portion of the spectrum (600-700 nm) or in both the blue-green and red portions of the spectrum;

Mode II: The ability of a lamp to change the emission in discrete steps by either emitting in the blue-green portion of the spectrum (400-500 nm blue and 500-600 nm green) or in the red portion of the spectrum (600-700 nm) or simultaneously both in the blue-green and in the red; here the light engine would have more than one string of LEDs and preferably two strings of LEDs; and Mode III: The ability of a lamp to emit, on-demand, any desired spectrum all the way from complete blue to complete red to any spectrum in between which gives the user complete freedom to choose any ratio of blue to the red in the spectrum. In this embodiment, the light engine would have more than one string of LEDs and preferably two strings of LEDs.

The present invention features, in one embodiment, a method of controlling a solid state lamp having a plurality of light emitting elements, wherein the plurality of light emitting elements include at least a first light emitting element configured for emitting light in a first light spectrum range and at least a second light emitting element configured for emitting light and a second light spectrum range. The method comprises the acts of providing a light emitting element control circuit, the light emitting element control circuit configured for electrically controlling at least one of the at least a first light emitting element and the at least a second light emitting element.

The light emitting element control circuit includes an electrical control circuit controller, operating under control of appropriate operating instructions stored in the electrical control circuit controller. The electrical control circuit controller is responsive to the appropriate operating instructions stored in the electrical control circuit controller and to a user adjustable light emitting element control circuit control device, for selectively controlling one or more of the at least one of the at least a first light emitting element and the at least a second light emitting element according to a position of the user adjustable light emitting element control circuit control device.

In one embodiment, the at least a first light emitting element includes at least one light emitting element in one of a blue visible light spectrum of between 400 to 500 nm and a green visible light spectrum between 500 and 600 nm, and wherein the at least a second light emitting element includes at least one light emitting element in the red visible light spectrum between 600 and 700 nm. The at least a first light emitting element may include a plurality of light emitting elements connected in series in at least one of the blue visible light spectrum and the green visible light spectrum, while the at least a second light emitting element may include a plurality of light emitting elements connected in series in the red visible light spectrum.

In the embodiment disclosed above, the user adjustable light emitting element control circuit control device may be selected from the group of control devices including at least a three position switch and a variable resistor variably adjustable from a fully clockwise position to a fully counterclockwise position.

In operation in mode I, user adjustable light emitting element control circuit control device is a variable resistor variably adjustable from a fully clockwise position to a fully counterclockwise position, and wherein the light emitting element control circuit controls one of the at least a first light emitting element and the at least a second light emitting element by controlling and amount of one of the voltage and current provided to the one of the at least a first light emitting element and the at least a second light emitting element according to the position of the user adjustable light emitting element control circuit control device.

In a second mode of operation (Mode II) the method according to one embodiment of the present invention provides that the user adjustable light emitting element control circuit control device is a three position switch. The light emitting element control circuit controls both the at least a first light emitting element and the at least a second light emitting element by controlling which one of the at least a first light emitting element and the at least a second light emitting element will be energized or whether both the at least a first and at least a second light emitting elements will be energized based on one of the three positions of the three position user adjustable light emitting element control circuit control device.

In a third mode of operation (Mode III) the method according to another embodiment of the present invention provides that the user adjustable light emitting element control circuit control device is a variable resistor variably adjustable from a fully clockwise position to a fully counterclockwise position, and wherein the light emitting element control circuit controls both the at least a first light the emitting element and the at least a second light emitting element by controlling a duty cycle of both the at least a first and at least a second light emitting element. Thereafter, based on the position of the variable resistor, the light emitting element control circuit is responsive to a fully clockwise position of the variable resistor for providing close to 100% duty cycle of the at least a first light emitting element and for providing close to 0% duty cycle to the at least a second light emitting element, and wherein the light emitting element control circuit is responsive to a fully counterclockwise position of the variable resistor, for providing close to 100% duty cycle of the at least a second light emitting element and for providing close to a 0% duty cycle to the at least a first light emitting element.

In another embodiment, the user adjustable light emitting element control circuit control device is disposed on an exterior region of the solid state lamp.

In another embodiment of the present invention, the invention includes a method of controlling a solid state lamp. The solid state lamp has a plurality of light emitting elements, wherein the plurality of light emitting elements including at least a first light emitting element configured for emitting visible light in a first visible light spectrum range and at least a second light emitting element configured for emitting visible light and a second visible light spectrum range. The at least a first light emitting element includes a plurality of light emitting elements connected in series and configured for emitting visible light in one of a blue visible light spectrum of between 400 to 500 nm and a green visible light spectrum between 500 and 600 nm, while the at least a second light emitting element includes a plurality of light emitting elements connected in series and configured for emitting visible light in the red visible light spectrum between 600 and 700 nm.

The method according to this embodiment comprises the acts of providing a light emitting element control circuit disposed in an interior region of the solid state lamp, the light emitting element control circuit configured for electrically controlling at least one of the at least a first light emitting element and the at least a second light emitting element. The light emitting element control circuit includes an electrical control circuit controller, operating under control of appropriate operating instructions stored in the electrical control circuit controller. The electrical control circuit controller is responsive to the appropriate operating instructions stored in the electrical control circuit controller and to a user adjustable light emitting element control circuit control device disposed on an exterior region of the solid state lamp, for selectively controlling one or more of the at least one of the at least a first light emitting element and the at least a second light emitting element according to a position of the user adjustable light emitting element control circuit control device, wherein the user adjustable light emitting element control circuit control device is selected from the group of control devices including at least a three position switch and a variable resistor variably adjustable from a fully clockwise position to a fully counterclockwise position.

The invention also features in another embodiment a power supply for a residential use horticultural lamp, wherein the power supply is configured for allowing the user to control a spectral power distribution of the lamp on demand at any point in an overall plant growth cycle. In another embodiment, spectral power distribution is controlled by controlling the ratio of spectral power emitted by two different LED strings by, for example, adjusting the duty cycle of an output from a microcontroller. The duty cycle may be adjusted by a potentiometer located on a body region of the horticultural lamp.

In another embodiment, the power supply features two different LED strings comprising a first LED string with LEDs emitting in the 600-700 nm region and a second LED string with LEDs emitting in the 400-600 nm blue-green region. The second LED string may have LEDs emitting in the 400-500 nm blue region.

In another embodiment, the power supply is user controllable to cause the horticultural lamp emit a spectral emission that is only in the blue 400-500 nm region and/or in the blue-green 400-600 nm region. The power supply may be user controllable to cause the horticultural lamp emit a spectral emission that is only in the red 600-700 nm region or in yet another embodiment the power supply is user controllable to cause the horticultural lamp emit a spectral emission that covers the full 400-700 nm range.

In another embodiment, the power supply may be controlled such that the blue-green 400-600 nm spectral range of the full 400-700 nm spectral range includes a red emission that is user selectable from 100% to 0% intensity while the red 600-700 nm spectral range of the full 400-700 nm spectral range includes a blue-green emission can be set at will from 100% to 0% intensity.

In yet a further embodiment, the power supply is formed from two distinct circuits involving a power converter section and an LED string current control section. In this embodiment, the power converter section may use a buck topology or in the output voltage range is from 30V to 90V for a 120 VAC input. In another embodiment, the power converter section may utilize a buck-boost topology wherein the output voltage range is from 30V to 280V for a 120 VAC input. In a further embodiment, the power converter section may utilize a flyback topology wherein the output voltage range is from 30V to 280V for a 120 VAC input.

In another embodiment of the power supply of the invention, the LED string current control section uses a microcontroller that enables switching between providing current to one or the other of the two LED strings. One embodiment contemplates that a small dead time is provided between two complementary outputs of the microcontroller to avoid the potential of driving the two LED strings at the same time. Preferably, the dead time is 50 s or less.

In yet another embodiment of the present invention, the switching frequency of the power supply between the two LED strings is between 300 Hz and 1 KHz, and potentially between 300 Hz and 400 Hz and more specifically between 320 Hz and 340 Hz.

Another embodiment of the present invention features a controller for a solid state lamp. The solid state lamp having a plurality of light emitting elements, the plurality of light emitting elements including at least a first light emitting element configured for emitting light in a first light spectrum range and at least a second light emitting element configured for emitting light and a second light spectrum range. The controller comprises a light emitting element control circuit, the light emitting element control circuit configured for electrically controlling at least one of the at least a first light emitting element and the at least a second light emitting element and a light emitting element control circuit including an electrical control circuit controller, operating under control of appropriate operating instructions stored in the electrical control circuit controller. The electrical control circuit controller is responsive to the appropriate operating instructions stored in the electrical control circuit controller and to a user adjustable light emitting element control circuit control device, for selectively controlling one or more of the at least one of the at least a first light emitting element and the at least a second light emitting element according to a position of the user adjustable light emitting element control circuit control device.

In another embodiment of the solid state lamp controller of the present invention, the at least a first light emitting element includes at least one light emitting element in one of a blue visible light spectrum of between 400 to 500 nm and a green visible light spectrum between 500 and 600 nm, and the at least a second light emitting element includes at least one light emitting element in the red visible light spectrum between 600 and 700 nm.

In one embodiment of the invention, the at least a first light emitting element includes a plurality of light emitting elements connected in series in at least one of the blue visible light spectrum and the green visible light spectrum, and the at least a second light emitting element includes a plurality of light emitting elements connected in series in the red visible light spectrum.

In another embodiment of the solid state lamp controller according to the present invention, the user adjustable light emitting element control circuit control device is selected from the group of control devices including at least a three position switch and a variable resistor variably adjustable from a fully clockwise position to a fully counterclockwise position. In another embodiment, the user adjustable light emitting element control circuit control device is a variable resistor variably adjustable from a fully clockwise position to a fully counterclockwise position, wherein the light emitting element control circuit controls one of the at least a first light emitting element and the at least a second light emitting element by controlling and amount of one of the voltage and current provided to the one of the at least a first light emitting element and the at least a second light emitting element according to the position of the user adjustable light emitting element control circuit control device.

In another embodiment of the solid state lamp controller according to the present invention, the user adjustable light emitting element control circuit control device may be a three position switch, wherein the light emitting element control circuit controls both the at least a first light emitting element and the at least a second light emitting element by controlling which one of the at least a first light emitting element and the at least a second light emitting element will be energized or whether both the at least a first and at least a second light emitting elements will be energized based on one of the three positions of the three position user adjustable light emitting element control circuit control device.

In another embodiment of the solid state lamp controller according to the present invention, the user adjustable light emitting element control circuit control device is a variable resistor variably adjustable from a fully clockwise position to a fully counterclockwise position, and the light emitting element control circuit controls both the at least a first light the emitting element and the at least a second light emitting element by controlling a duty cycle of both the at least a first and at least a second light emitting element based on the position of the variable resistor. The light emitting element control circuit may be responsive to a fully clockwise position of the variable resistor for providing close to 100% duty cycle of the at least a first light emitting element and for providing close to 0% duty cycle to the at least a second light emitting element, and wherein the light emitting element control circuit is responsive to a fully counterclockwise position of the variable resistor, for providing close to 100% duty cycle of the at least a second light emitting element and for providing close to a 0% duty cycle to the at least a first light emitting element. In another embodiment, the user adjustable light emitting element control circuit control device is disposed on an exterior region of the solid state lamp.

The present invention also features, according to another embodiment, a controller for solid state lamp having a plurality of light emitting elements. The plurality of light emitting elements include at least a first light emitting element configured for emitting visible light in a first visible light spectrum range and at least a second light emitting element configured for emitting visible light and a second visible light spectrum range. The at least a first light emitting element includes a plurality of light emitting elements connected in series and configured for emitting visible light in one of a blue visible light spectrum of between 400 to 500 nm and a green visible light spectrum between 500 and 600 nm, and wherein the at least a second light emitting element includes a plurality of light emitting elements connected in series and configured for emitting visible light in the red visible light spectrum between 600 and 700 nm.

The controller comprises a light emitting element control circuit disposed in an interior region of the solid state lamp. The light emitting element control circuit is configured for electrically controlling at least one of the at least a first light emitting element and the at least a second light emitting element. The light emitting element control circuit includes an electrical control circuit controller, operating under control of appropriate operating instructions stored in the electrical control circuit controller, and responsive to the appropriate operating instructions stored in the electrical control circuit controller and to a user adjustable light emitting element control circuit control device disposed on an exterior region of the solid state lamp, for selectively controlling one or more of the at least one of the at least a first light emitting element and the at least a second light emitting element according to a position of the user adjustable light emitting element control circuit control device. The user adjustable light emitting element control circuit control device is selected from the group of control devices including at least a three position switch and a variable resistor variably adjustable from a fully clockwise position to a fully counterclockwise position.

The present invention is not to be restricted or limited to any presented embodiment which is described for exemplary purposes only. Modifications and substitutions by one of ordinary skill in the art are considered to be within the scope of the present invention

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
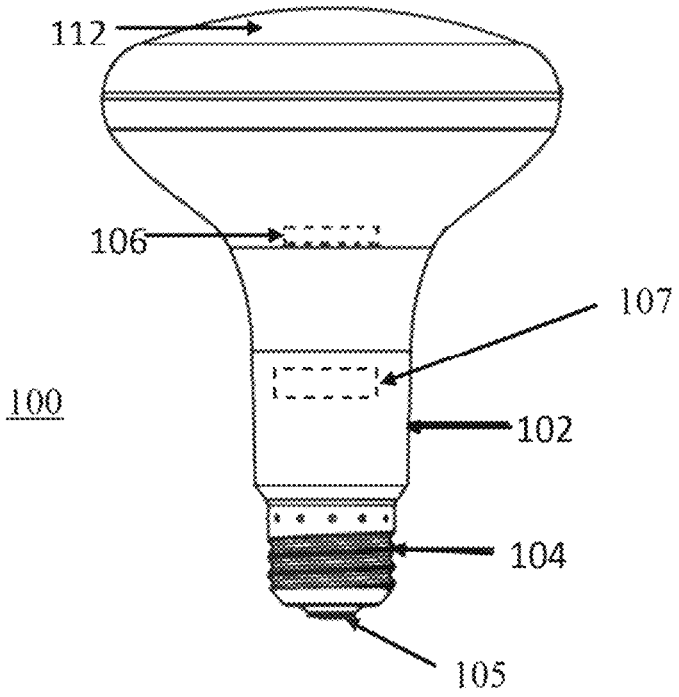
FIG. 1 is schematic side view of a solid state lamp in accordance with one embodiment of the present invention.
Figure 2:
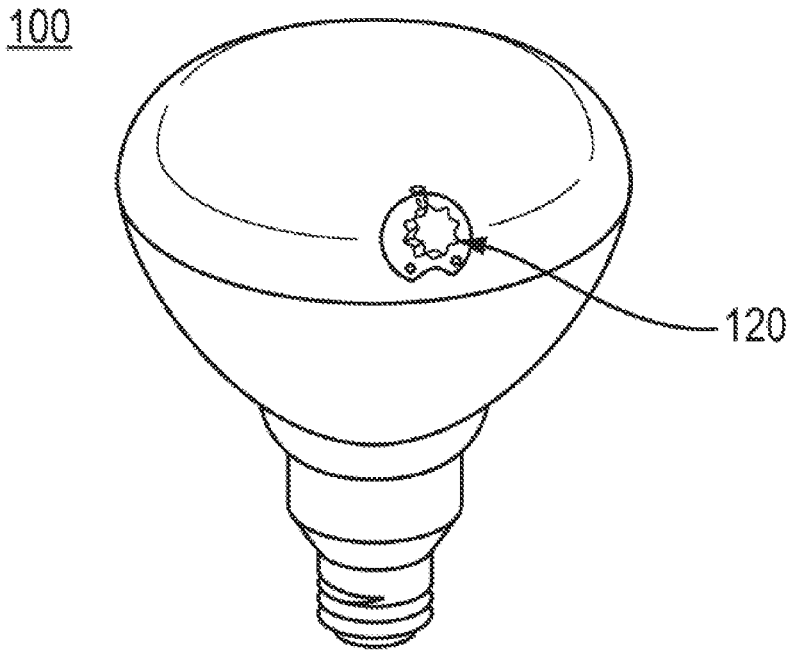
FIG. 2 is a side perspective view of a solid state lamp in accordance with one embodiment of the present invention illustrating a user adjustable light-emitting element control device on the exterior of a solid state lamp.

FIGS. 1 and 2 illustrate an example solid-state lamp 100 configured in accordance with an embodiment of the present disclosure. As can be seen, lamp 100 typically includes a body portion 102, the material, geometry, and dimensions of which may be customized, as desired for a given target application or end-use as well known to those skilled in the art to which the invention pertains. Lamp 100 also includes a base portion 104 configured to be operatively coupled with a given power socket so that power may be delivered to lamp 100 for operation thereof. To that end, base portion 104 may be of any standard, custom, or proprietary contact type and fitting size, as desired for a given target application or end-use. In some cases, base portion 104 may be configured as a threaded lamp base including an electrical foot contact 105 as shown in FIG. 1. In some other cases, base portion 104 may be configured as a bi-pin, tri-pin, or other multi-pin lamp base while in some other cases, base portion 104 may be configured as a twist-lock mount lamp base. The base portion 104 may also be configured as a bayonet connector lamp base. Other suitable configurations for body portion 102 and base portion 104 will depend on a given application and will be apparent in light of this disclosure and well-known to those skilled in the art.

As will be appreciated in light of this disclosure, a lamp 100 configured as variously described herein may be compatible with power sockets/enclosures typically used in existing luminaire structures. For example, some embodiments may be of a PAR20, PAR30, PAR38, or other parabolic aluminized reflector (PAR) configuration lamps. Some embodiments may be of a BR30, BR40, or other bulged reflector (BR) lamp configuration while some embodiments may be of an A19, A21, or other A-line lamp configuration. An additional example of yet another embodiment may be of a T5, T8, or other tube configuration.

In accordance with some embodiments, a lamp 100 configured as variously described herein may be considered, in a general sense, a retrofit or other drop-in replacement lighting component. As will be further appreciated in light of this disclosure, the particular configuration of a lamp 100 may be customized, for instance, to provide a given amount of photosynthetic photon flux (PPF) desired for a given horticultural or other target application or end-use.

FIG. 2 illustrates an exemplary horticultural lamp 100 of the type BR40 that includes the power supply/driver described in the present invention (not shown in this figure) as well as a user-friendly potentiometer 120 that is part of the driver circuitry in accordance with the teachings of the present invention, that enables the user to obtain different spectral power distributions from the horticultural lamp 100 by moving the knob on potentiometer 122 to either of 2 extreme positions (blue emission only at extreme left and red emission only at extreme right) and/or any desired combined spectrum for any potentiometer position in between these 2 extremes.

Figure 3:
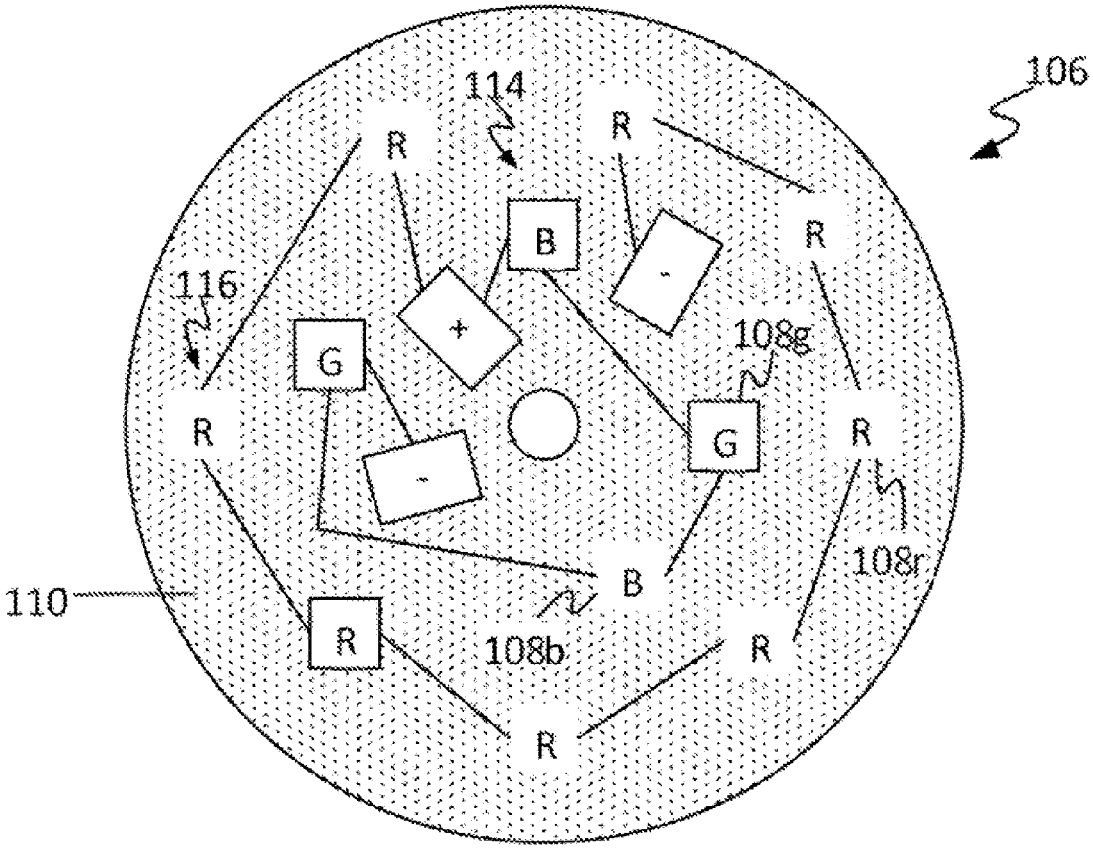
FIG. 3 is a schematic plan view of a light module in accordance with one embodiment of the present invention.

Lamp 100 includes one or more light source modules 106. FIG. 3 illustrates a plan view of a light source module 106 configured in accordance with an embodiment of the present disclosure. As can be seen, light source module 106 may include one or more solid-state emitters 108 populated over a printed circuit board (PCB) 110 (e.g., a metal-core PCB) or other suitable intermediate or substrate.

In accordance with one or more embodiments, a given emitter 108 may be a semiconductor light source, such as a light-emitting diode (LED), an organic light-emitting diode (OLED), or a polymer light-emitting diode (PLED), among others. A given emitter 108 may be configured to emit electromagnetic radiation (e.g., light) from any one, or combination, of spectral bands, such as, for example, the visible spectral band, the infrared (IR) spectral band, and the ultraviolet (UV) spectral band, among others.

A given emitter 108 may be configured for emissions of a single correlated color temperature (CCT) or for color-tunable emissions, as desired. Thus, and in accordance with some embodiments, a given emitter 108 may be configured to emit any one, or combination, of blue, green, and red light. Also, the electrical power (wattage) of a given emitter 108 may be customized, as desired for a given target application or end-use. In some cases, a given emitter 108 may be a low-power semiconductor light source having a wattage of about 1 W or less (e.g., about 0.25 W or less, about 0.5 W or less, about 0.75 W or less, or any other sub-range in the range of about 1 W or less). In some cases, a given emitter 108 may be a high-power semiconductor light source having a wattage of about 1 W or greater (e.g., about 1.25 W or greater, about 1.5 W or greater, or any other sub-range in the range of about 1 W or greater). Other suitable configurations for emitters 108 will depend on a given application and will be apparent to those skilled in the art in light of this disclosure.

Any given emitter 108 may be electrically coupled with PCB 110 via any suitable standard, custom, or proprietary electrical coupling means, such as, for example, solder pads on a metal-core PCB, where the emitters 108 are reflow soldered onto PCB 110 (optionally with one or more intervening layers). In some cases, PCB 110 further may include other componentry populated there over, such as, for example, resistors, transistors, capacitors, integrated circuits, and power and control connections for a given emitter 108, to name a few examples. All (or some sub-set) of emitters 108 of light source module 106 may be operatively coupled in series or in parallel (or a combination of both), as desired for a given target application or end-use.

The arrangement of emitters 108 over PCB 110 may be customized, as desired for a given target application or end-use. For instance, in some embodiments, emitters 108 may be distributed, in part or in whole, as a regular array in which all (or some sub-set) of emitters 108 are arranged in a systematic manner in relation to one another over PCB 110. In some other embodiments, emitters 108 may be distributed, in part or in whole, as a semi-regular array in which a sub-set of emitters 108 are arranged in a systematic manner in relation to one another over PCB 110, but at least one other emitter 108 is not so arranged. In some other embodiments, emitters 108 may be distributed, in part or in whole, as an irregular array in which all (or some sub-set) of emitters 108 are not arranged in a systematic manner in relation to one another over PCB 110.

In accordance with some embodiments, emitters 108 of light source module 106 may be arranged in a single string or in multiple (e.g., two or more) strings. For instance, the exemplary embodiment shown in FIG. 3 includes a first string 114 of emitters 108 and a separate second string 116 of emitters 108. In some cases, for a given string 114, 116, all the constituent emitters 108 may be configured to emit only the same single light color (e.g., red, green, or blue). In some other cases, for a given string 114, 116, one sub-set of the constituent emitters 108 may be configured to emit a first light color, whereas a second sub-set may be configured to emit a different second light color (e.g., red and blue; red and green; green and blue). The quantity, density, and spacing between neighboring emitters 108 over PCB 110 may be customized, as desired for a given target application or end-use.

In accordance with some embodiments, such as the example embodiment shown in FIG. 3, light source module 106 may include: (1) a first sub-set of emitters 108*b* configured to emit light of a first sub-set of wavelengths (e.g., blue light); (2) a second sub-set of emitters 108*g* configured to emit light of a different second sub-set of wavelengths (e.g., green light); and (3) a third sub-set of emitters 108*r* configured to emit light of a different third sub-set of wavelengths (e.g., red light). Also, as shown in this example embodiment, the first sub-set of emitters 108*b* and the second sub-set of emitters 108*g* may be constituents of a first string 114 of emitters 108, and the third sub-set of emitters 108*r* may be constituents of a different second string 116 of emitters 108.

In at least one example embodiment, first string 114 includes two blue emitters 108*b* and two green emitters 108*g*, and second string includes eight red emitters 108*r*. Of course, the quantity, density, and spacing between neighboring emitters 108 for a given string 114, 116 may be customized as desired. Also, the quantity of emitters 108 of each color (e.g., blue emitters 108*b*; green emitters 108*g*; red emitters 108*r*) may be customized. In addition, the electrical power (wattage) of each individual emitter 108 may be customized to achieve a given desired SPD, and the present disclosure is not intended to be limited only to the example configuration depicted via FIG. 3. In cases where multiple strings (e.g., a first string 114 and a second string 116) are utilized, the forward voltage of the individual emitters 108 may be selected to have the desired voltage difference between strings 114, 116, in accordance with some embodiments. Numerous configurations and variations will be apparent in light of this disclosure. The power converter/controller described in this invention provides the proper voltage and current to the various LED strings in the light source module 106.

In accordance with some embodiments of a lamp including a power supply controllable according to the methods disclosed herein, lamp 100 also may include one or more optics 112, which may have any of a wide range of configurations. A given optic 112 may be configured to transmit, in part or in whole, emissions received from a given emitter 108 optically coupled therewith, in accordance with some embodiments. A given optic 112 may be configured, in accordance with some embodiments, for increasing and/or decreasing the output beam angle. A given optic 112 may be formed from any one, or combination, of suitable optical materials. For instance, in some embodiments, a given optic 112 may be formed from a polymer, such as poly (methyl methacrylate) (PMMA) or polycarbonate, among others. In some embodiments, a given optic 112 may be formed from a ceramic, such as sapphire ($Al_2O_3$) or yttrium aluminum garnet (YAG), among others while in some embodiments, a given optic 112 may be formed from a glass. In some embodiments, a given optic 112 may be formed from a combination of any of the aforementioned materials. Furthermore, the dimensions and geometry of a given optic 112 may be customized, as desired for a given target application or end-use.

In some embodiments, a given optic 112 may be or otherwise include a lens, such as a Fresnel lens, a converging lens, a compound lens, or a micro-lens array, to name a few as well as an optical dome or optical window. In some cases, a given optic 112 may be formed as a singular piece of optical material, providing a monolithic optical structure. In some other cases, a given optic 112 may be formed from multiple pieces of optical material, providing a polylithic (multi-piece) optical structure. In some instances, a given optic 112 may be configured to filter light transmitted there through. Other suitable configurations for optic(s) 112 will depend on a given application and will be apparent to those skilled in the art in light of this disclosure.

As will be appreciated in light of this disclosure, lamp 100 further may include or otherwise have access to any of a wide range of other electronic components employable with solid-state lamps and luminaires. For instance, in some embodiments and as will be described further herein as a feature of the present invention, lamp 100 may include or otherwise have access to power conversion componentry 107, such as electrical ballast circuitry, configured to convert an AC signal into a DC signal at a desired current/voltage to power a given light source module 106. In some instances, lamp 100 may include self-ballasted electronics (e.g., disposed within base portion 104 or other portion of lamp 100). In some embodiments, lamp 100 may include or otherwise have access to constant current/voltage driver componentry. In some embodiments, lamp 100 may include or otherwise have access to communication componentry (e.g., such as a transmitter, a receiver, or a transceiver) configured for wired or wireless communication (or both) to and/or from the lamp 100 utilizing any suitable means, such as Universal Serial Bus (USB), Ethernet, FireWire, Wi-Fi, Bluetooth, ZigBee, or a combination thereof, among others. In some embodiments, lamp 100 may include or otherwise have access to processing componentry, such as a central processing unit (CPU) or a microcontroller unit (MCU), among others.

In accordance with the disclosure of the present invention, lamp 100 includes or otherwise has access to one or more drivers configured to be operatively coupled with emitters 108. In some cases, a given driver may be native to lamp 100 (e.g., disposed within body portion 102 or other portion of lamp 100) or native to a given emitter 108, whereas in some other cases, a given driver may be native to a luminaire (i.e. lighting fixture) configured to be operatively coupled with lamp 100. A given driver may be a single-channel or multi-channel electronic driver and, in some cases, may be a high-current driver. In accordance with some embodiments, a given driver may be configured to drive a given emitter 108 utilizing any suitable standard, custom, or proprietary driving techniques. In some cases, lamp 100 may include or otherwise have access to a driver configured to provide for electronic adjustment, for example, of the PPF, spectral power, spectral intensity, ratio of PPF, spectral power and spectral intensity in the blue, green, and/or red regions, or a combination of any one or more thereof, as desired for a given target application or end-use. Other suitable driver configurations will depend on a given application and will be apparent in light of this disclosure.

In accordance with the preferred embodiment disclosed herein, lamp 100 includes or otherwise has access to one or more controller circuits 107 configured to be operatively coupled with emitters 108. In some cases, a given controller may be native to lamp 100 (e.g., disposed within body portion 102 or other portion of lamp 100) or native to a given emitter 108, whereas in some other cases, a given controller may be native to a luminaire (lighting fixture) configured to be operatively coupled with lamp 100. The emitters 108 of lamp 100 may be electronically controlled to provide lamp 100 with highly adjustable light emissions, in accordance with the preferred embodiment and as will be described in greater detail below. A given controller may host one or more lighting control modules and may be programmed or otherwise configured to output one or more control signals that may be utilized in controlling the operation of a given emitter 108 of lamp 100, in accordance with some embodiments.

For instance, in some embodiments, a given controller may include an intensity adjustment module and may be configured to output control signal(s) to control the intensity (e.g., brightness or dimness) of the light emitted by a given emitter 108. In some embodiments, a given controller may include a color adjustment module and may be configured to output control signal(s) to control the color (e.g., wavelength) of the light emitted by a given emitter 108. In some embodiments, a given controller may be configured to output control signal(s) for use in controlling whether a given emitter 108 is in an on state or an off state. It should be noted, however, that the present disclosure is not intended to be limited only to these example lighting control modules and output signals. Additional and/or different lighting control modules and output signals may be provisioned, as desired for a given target application or end-use. Numerous variations and configurations will be apparent in light of this disclosure.

In accordance with some embodiments, the module(s) of a given controller can be implemented in any suitable standard, custom, or proprietary programming language, such as, for example, C, C++, objective C, JavaScript, or any other suitable instruction set, as will be apparent in light of this disclosure. The module(s) of a given controller can be encoded, for example, on a machine-readable medium that, when executed by a processor, carries out the functionality of lamp 100, in part or in whole. The computer-readable medium may be, for example, a hard drive, a compact disk, a memory stick, a server, or any suitable non-transitory computer or computing device memory that includes executable instructions, or a plurality or combination of such memories. Some embodiments can be implemented, for instance, with gate-level logic, an application-specific integrated circuit (ASIC) or chip set, or other such purpose-built logic. Some embodiments can be implemented with a microcontroller having input/output capability (e.g., inputs for receiving user inputs; outputs for directing other components) and a number of embedded routines for carrying out device functionality. In a more general sense, the functional modules of a given controller can be implemented in any one, or combination, of hardware, software, and firmware, as desired for a given target application or end-use.

In some modes of the preferred embodiment, light source module 106 may be configured such that all its emitters 108, or at least one of each type of emitter 108 (e.g., blue emitters 108*b*, green emitters 108*g*, and red emitters 108*r*), may be activated to emit simultaneously. Thus, light source module 106 can be operated to emit a blend of blue, green, and red light.

However, the present disclosure is not intended to be so limited, as in accordance with some embodiments, light source module 106 may be configured such that only one or more sub-sets of emitters 108 may be activated at a time. For example, in some embodiments, light source module 106 can be operated to emit only blue, green, or a blend of blue and green light. To this end, a first string 114 of only blue emitters 108*b* and green emitters 108*g* may be activated, in accordance with one embodiment. In another embodiment, light source module 106 can be operated to emit only red light; for instance. To this end, a second string 116 of only red emitters 108*r* may be activated, in accordance with some embodiments.

Preferred Embodiment

The light emitting element control circuit 107 described in this invention disclosure enables the operation of a horticultural lamp in three distinct modes, which allows the user significant flexibility in operation of the lamp. It enables the user to operate the lamp with a fixed emission spectrum but with intensity control (Mode I). It also allows the user to operate the lamp with discrete settings of blue only or red only or a fixed ratio of the two (Mode II). Finally, the invention allows the user to have an on-demand control (Mode III) of the ratio of blue to red emission: the user can operate the lamp with any arbitrary ratio of blue to red for example to meet different spectral requirements for different phases of plant growth. This adjustability improves the yield and quality of the plants and vegetables. The present invention describes several different ways of driving the LED strings in a horticultural lamp. Specifically, three embodiments are described in the present application.

In the first mode of operation arbitrarily labeled Mode I, the present invention provides the ability of a lamp to produce a fixed emission spectrum while enabling the user to be able to change the intensity of emission from 50% to 100%. In this embodiment, the light source 106 would have one string of LED's, either emitting in the blue-green portion of the spectrum (400-500 nm, the blue and 500-600 nm green spectrum) or in the red portion of the spectrum (600-700 nm) or in both the blue-green and red portions of the spectrum In the second mode of operation labeled Mode II, the present invention includes the ability to change the emission in discrete steps by either emitting in the blue-green portion of the spectrum (400-500 nm blue and 500-600 nm green) or in the red portion of the spectrum (600-700 nm) or simultaneously both in the blue-green and in the red. In this embodiment, the light source 106 would be configured as more than one string of LEDs and preferably two strings of LEDs.

Lastly, in the third mode of operation labeled Mode III, the present invention details the ability to cause the lamp 100 to emit on-demand any desired spectrum all the way from complete blue to complete red to any spectrum in between which gives the user complete freedom to choose any ratio of blue to the red in the spectrum. Again in this embodiment, the light source or light engine 106 would be configured to have more than one string of LEDs and preferably two strings of LEDs.

In the detailed description that follows, these three embodiments will be referred to and explained as Mode I, Mode II and Mode III respectively. In Mode I, there is a single LED or a single LED string and the ability to change the drive current to the LEDs to change the intensity of emission. In Mode II, the present invention provides step control on two strings of LEDs but no "dimmability" is called for in each string. In Mode III, the present invention contemplates having two strings of LEDs with continuous control of output spectrum and the ability to go with all blue output (important for young plants and saplings), as well as the ability to reduce/eliminate blue light output and increase red light output as the plant moves from the stem/leaf stage to the flowering/fruiting stage depending on the desire of the user, and the ability to change to all red emission to promote flowering and fruiting.

The three modes of control of the horticultural lamp referred to earlier as Modes I, II and III is accomplished utilizing a light emitting element control circuit 107 which will now be described in greater detail. The description of the light emitting element control circuit 107 that follows will refer to two sections named "Power Converter Section" and "String Current Control Section". Mode 1 operation uses the Power Supply Section only as there is only one LED/LED string that needs to be controlled. For operational Modes II and III, one needs both the Power Supply Section and the LED String Current Control section as there are two LED strings that need to be controlled.

Power Converter Section

Figure 4:
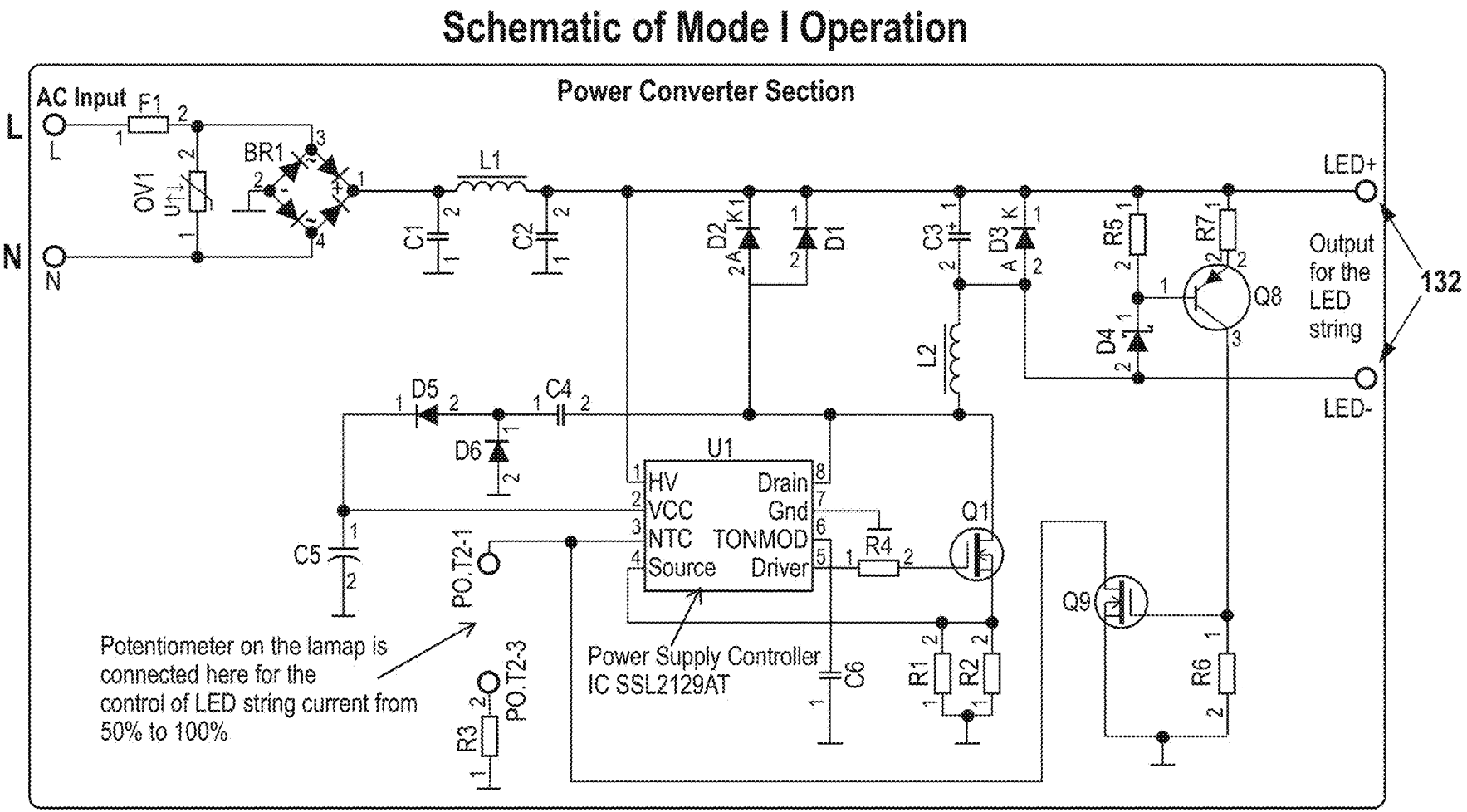
FIG. 4 is a schematic diagram of a power supply portion of a light-emitting element control circuit in accordance with the teachings of the present invention.

The Power converter section 130, shown in FIG. 4, takes the 120V 60 Hz input and provides a filtered DC voltage output. This is achieved by using a full bridge rectifier, a filter and a buck power conversion topology using a critical conduction mode (CRM) operation feature of the controller IC SSL2129AT. The present invention is not limited to using just this specific IC controller or just this topology. Other topologies like buck, buck-boost or fly-back may also be employed along with alternate controller ICs suitable for AC to DC power conversion. The operation in CRM is intended to produce low total harmonic distortion in the input current and avoid hard switching of the buck diode D1/D2. This also helps to improve driver efficiency which minimizes lamp input wattage and lowers driver component temperatures. The buck converter converts 120V AC line input into a single DC output.

Figure 8:
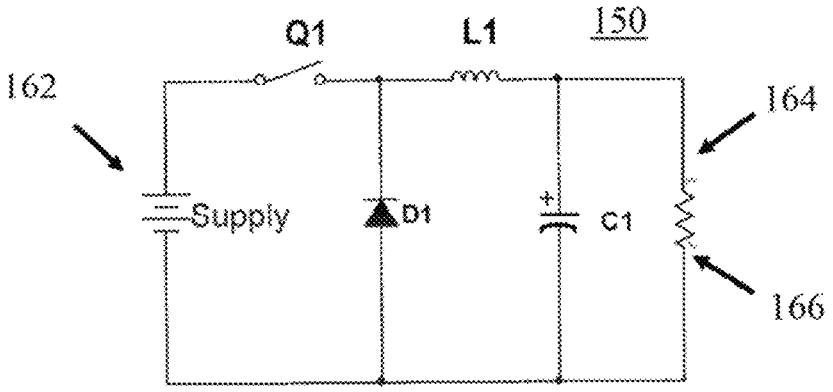
FIG. 8 is a schematic diagram of an exemplary buck topology circuit.

Buck topology is a non-isolated topology and is one of the common power supply topologies used for lowering or stepping down of the voltage. The output voltage of this topology is always less than the input voltage and has the same polarity as the input. Preferred output voltages range from 30V to 90V for a 120V AC input. A concept schematic of one embodiment of the buck topology 160 is shown in FIG. 8.

When switch Q1 is ON, the difference between the input voltage 162 and output voltage 164 will appear across the Inductor L1 and current will begin to increase. During this time, the capacitor C1 will also get charged and the current will be supplied to the load 166 as well. The inductor L1 stores energy in the form of a magnetic field during this time. When switch Q1 is OFF, the current through the inductor L1 will reduce. The inductor will act as current source and deliver the energy it has stored to the load 166. The capacitor C1 will also provide energy to the load 166 as the voltage across the inductor L1 begins to fall. In this topology, the duty cycle is dependent on the ratio of the output voltage 164 to the input voltage 162. The lower output voltage results in lower duty cycle. Duty cycle is the ratio of the switch Q1 ON time to the total period (ON time+OFF time) of the switching cycle. Lower duty cycle causes higher total harmonic distortion. This topology results in a very good efficiency. These performance parameters affect the choice of topology.

Figure 9:
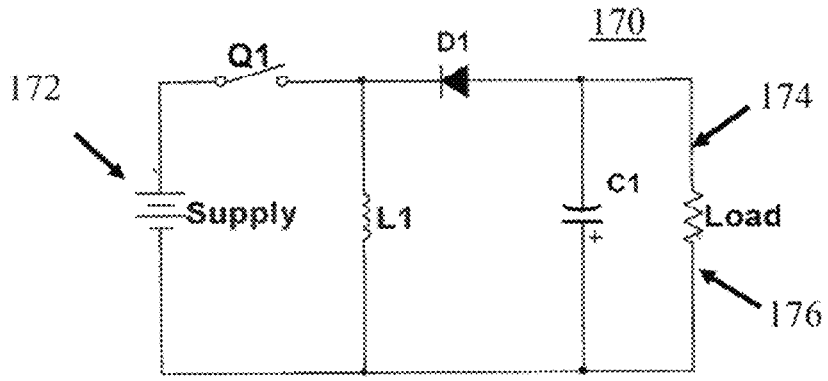
FIG. 9 is a schematic diagram of an exemplary buck-boost topology circuit.

An example of the buck Boost topology 170, FIG. 9, allows the output voltage 174 to be higher or lower than the input voltage 172. The range of preferred output voltage for a 120 VAC input lies between 30V to 280V. This is similar to a fly-back topology except that buck boost uses an inductor L1 while fly-back topology uses a transformer. The polarity of the output of this topology is opposite to the polarity of the input. A concept schematic of this topology is shown in FIG. 9.

When switch Q1 is ON, the entire input voltage 172 will appear across the inductor L1 and the current through L1 will begin to increase. During this time, the diode D1 will be reverse biased and capacitor C1 will supply the current to the load 176. When switch Q1 is OFF, the inductor L1 will discharge and deliver the current to capacitor C1 and to the load 176. In this topology also, the higher the output voltage, the higher the duty cycle.

Figure 10:
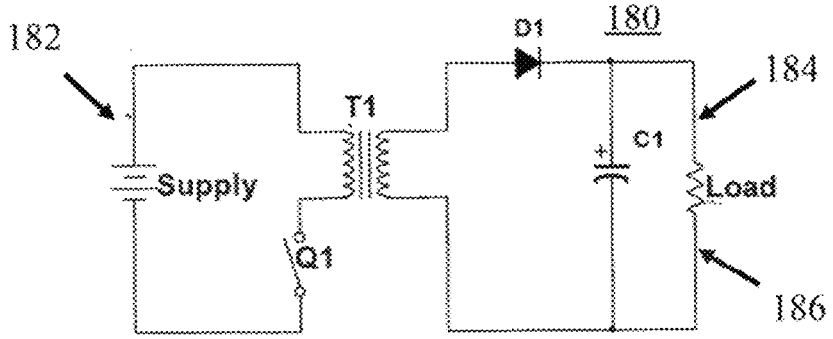
FIG. 10 is a schematic diagram of an exemplary fly-back topology circuit.

An example of the fly-back topology 180, FIG. 10, also allows the output voltage 184 to be higher or lower than the input voltage 182. The range of preferred output voltage 184 for a 120 VAC input voltage 182 is between 30V to 280V. However, unlike buck and buck boost topologies, this topology provides electrical isolation between input and output. Hence the output 184 is "floating" with respect to input 182 which provides benefits in safety. When the switch Q1 is ON, the entire input voltage 182 will appear across the transformer T1 and the current through T1 will begin to increase. During this time, the diode D1 will be reverse biased and capacitor C1 will supply the current to the load 186. When switch Q1 is OFF, transformer T1 will discharge and deliver the current to capacitor C1 and to the load 186. In this topology also, the higher the output voltage, higher the duty cycle and lower total harmonic distortion.

The output voltage and power levels for all topologies are matched to the needs of the load which happens to be the single LED or single LED string for Mode I and two LED strings in parallel for Modes II and III. The single string can either have just blue and green LEDs or just red LEDs or all three colors of LEDs i.e. green, blue and red.

For operation in Mode I, the user adjustable light emitting element control circuit control device 120 is a variable resistor, also called a potentiometer, disposed on the exterior of the lamp easily accessible to the user. The potentiometer is connected to the NTC terminal, Pin 3, of the controller IC. The NTC terminal of the IC also has the dimming feature. The power converter output is connected to only a single string of LEDs and the LED string current is controlled from 50% to 100% based on the control input from the potentiometer.

For Mode II operation, the power converter output 132 is connected to two LED strings through two MOSFETs (Q2 and Q3) which act as switches. When a specific MOSFET is turned ON, all the power converter current flows through that LED string. Which LED string is powered depends on the position of the user adjustable light emitting element control circuit control device which in this embodiment is an ON/OFF/ON switch 120 disposed on the exterior of the lamp 100. The ON/OFF/ON position turns on String 1 only (string with blue LEDs), both Strings (blue string AND red string) or String 2 (string with red LEDs) only.

For Mode III operation, the power converter output 132 is connected to two LED strings through two MOSFETs which act as switches. When the MOSFET is turned ON, all the power converter current flows through that LED string. The position of the potentiometer 120 located on the exterior of the lamp in this particular embodiment in between the two extreme end positions determines the operating duty cycle.

At one extreme end of the potentiometer, one LED string is powered (blue string of LEDs) and at the other extreme end of the potentiometer the other LED string is powered (red LED string). In between, both the LED strings are powered and the horticultural lamp emits a spectrum which is the combined emission of the two strings of LEDs (blue and red light). The duty cycle of the two strings depends on the exact position of the potentiometer. Thus the user can change the lamp spectral emission all the way from complete blue at one extreme end of the potentiometer to complete red at the other extreme end of the potentiometer to any spectral ratio of red to blue depending on where the customer sets the user adjustable potentiometer.

As has been stated above, String 1 can either be just blue LEDs or a few green LEDs may be added to that string for addition of green light to the emission spectrum of the horticultural lamp. Accordingly, in the enclosed description referrers to String 1 as being the blue LED string, it is also implied that this string could additionally include one or more green LEDs as well.

Power Converter Section Circuit Description:

With reference to FIG. 4 in the disclosed power conversion circuit 130 (which is reproduced identically and utilized in mode II, FIG. 5 and mode III, FIG. 6), a 120V input is applied to terminals L and N. The Fuse F is used for protection against input over current in the event of any fault due to component failures in the circuit. MOV1 is used to protect the lamp from failure against line transients. The Inductor L1 and Capacitors C1, C2 form an EMI filter to limit the conducted emissions from the lamp to be within the FCC Part 15 class B limits. BR1 is the full bridge rectifier to convert the AC input line voltage to DC output.

The rectified DC is fed to a buck converter based on controller IC U1 SSL2129AT operating in the Critical Conduction Mode (CCM). Any similar IC that is suitable for buck conversion could be used. Resistors R1 and R2 are current sense resistors which provide the feedback of the current though the FET Q1 so that the peak current can be controlled.

Overvoltage protection of the driver in the event of open circuit on the driver outputs is accomplished via R5, R7, R6, D4, Q8, Q9. The value of Zener diode D4 determines the output voltage threshold when the overvoltage protection is triggered. Diode D3 is a provision for overvoltage protection in the event Q8 based overvoltage circuit is not used. Either of the two overvoltage methods can be used based on the performance and cost for a given application.

Inductor L2 is power inductor that stores the energy during the ON state of the FET Q1 and releases the energy to output during its OFF state. Diodes D5, D6 and C5 form the power supply circuit for powering the IC. The gate of the FET Q1 is driven by the controller IC U1 based on the input voltage and the LED load connected to the converter output. Capacitor C6 is used to limit the maximum Turn ON time of the IC. This will help limit the peak current through the inductor and also limit the total output power. The potentiometer P2 connected to NTC pin of U1 along with resistor R3 provides the dimming functionality of the control circuit 130.

The resistor R4 value can be adjusted to limit the electromagnetic emissions from the driver. Proper EMI and efficiency performance tradeoff is necessary in setting this value. Loss in driver efficiency will lead to higher lamp wattage and higher component temperatures. Diode D2 is an ultra-fast recovery diode which has a very fast ON and OFF time. This helps reduce power losses in the diode due to switching. This diode is forward biased and releases the energy to the output when the FET is OFF.

The circuit has provision for D1 which has the same function as D2 but has better thermal conductivity. D1 may be used instead of D2 in case there are any thermal concerns when the lamp is operating at high ambient temperature. Capacitor C3 is an electrolytic capacitor that filters the switching frequency ripple on the output. It also reduces the low frequency ripple on the output and provides a smoother output current into the LEDs. This helps reduce the flicker % which is the depth of modulation of the output current flowing into the LED strings. It also enables to keep the peak current in the LED strings within allowable limits. High peak currents can affect LED life.

LED String Current Control Section Circuit Description

Figure 5A:
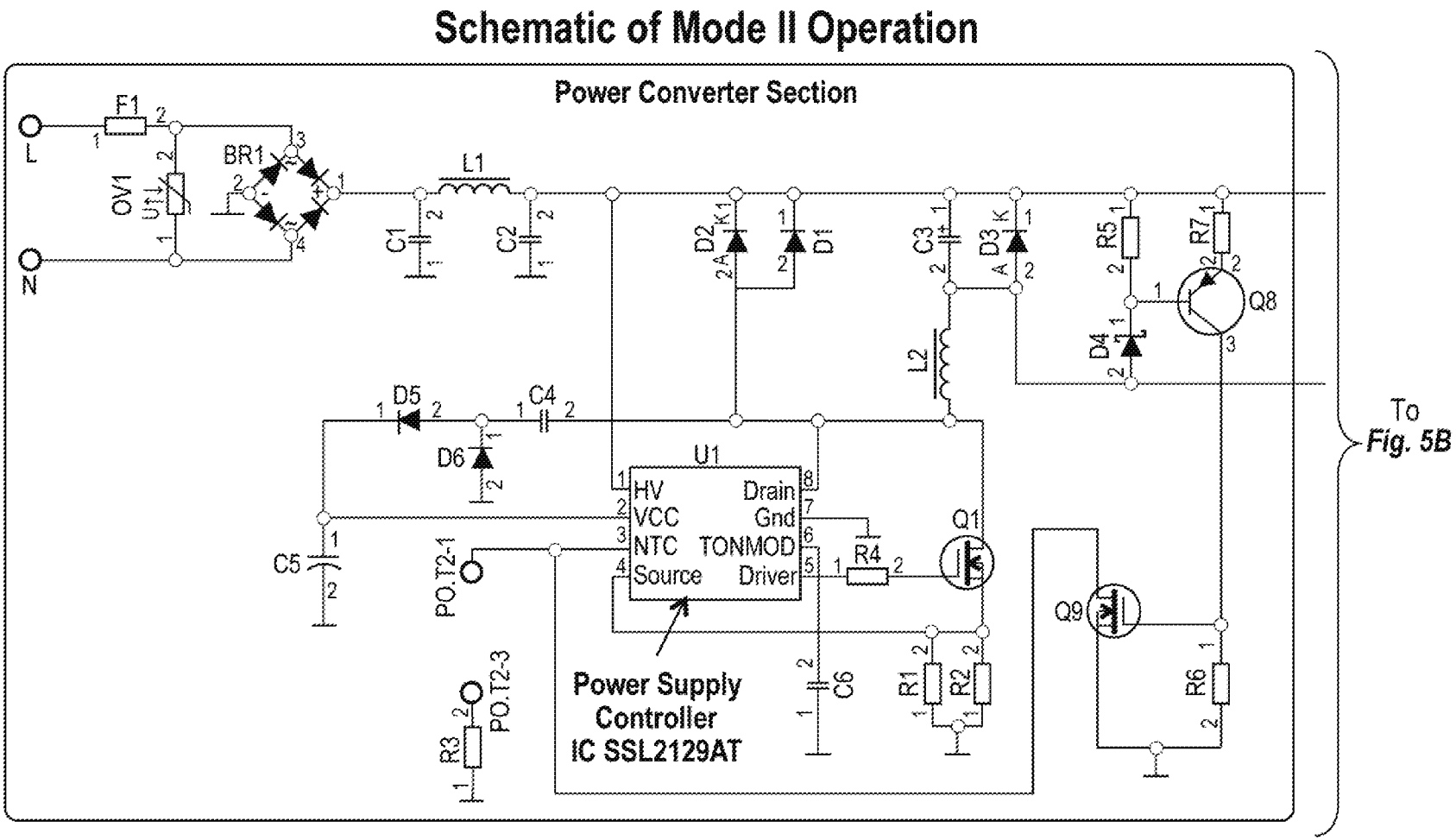
FIG. 5 is a schematic diagram of a light-emitting element control circuit in accordance with one embodiment of the present invention.
Figure 5B:
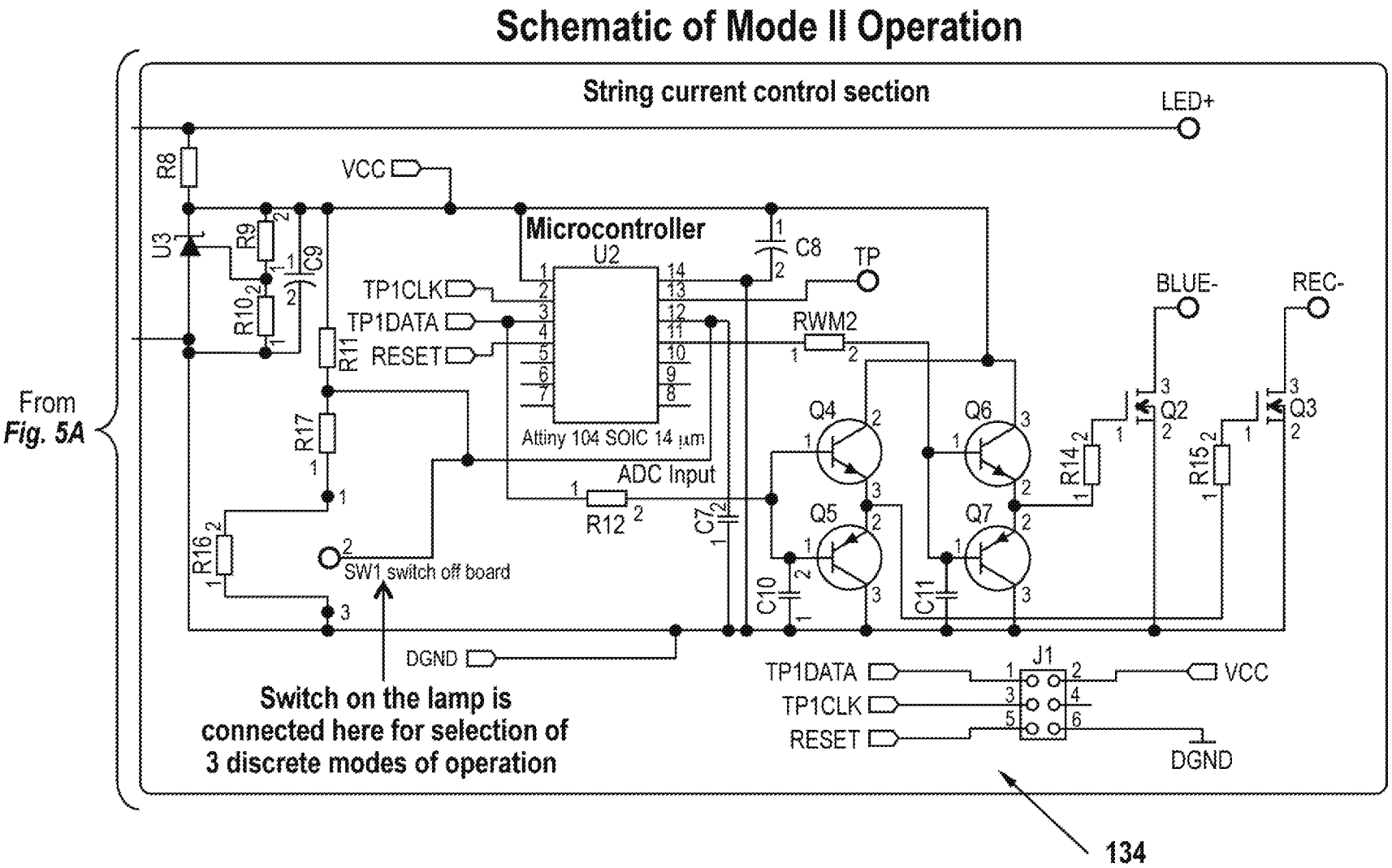
Figure 6A:
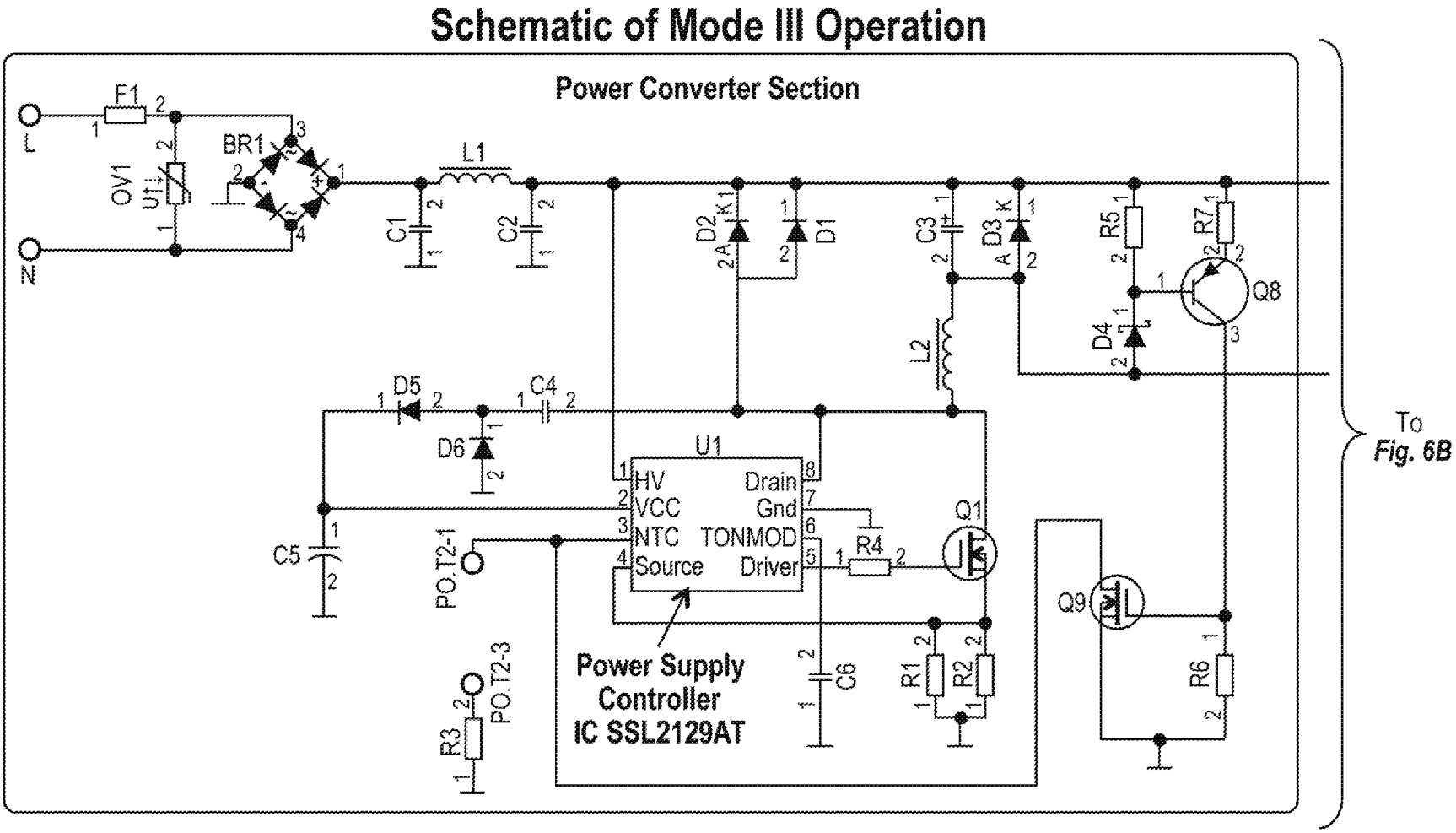
FIG. 6 is a schematic diagram of a light-emitting element control circuit in accordance with another embodiment of the present invention.
Figure 6B:
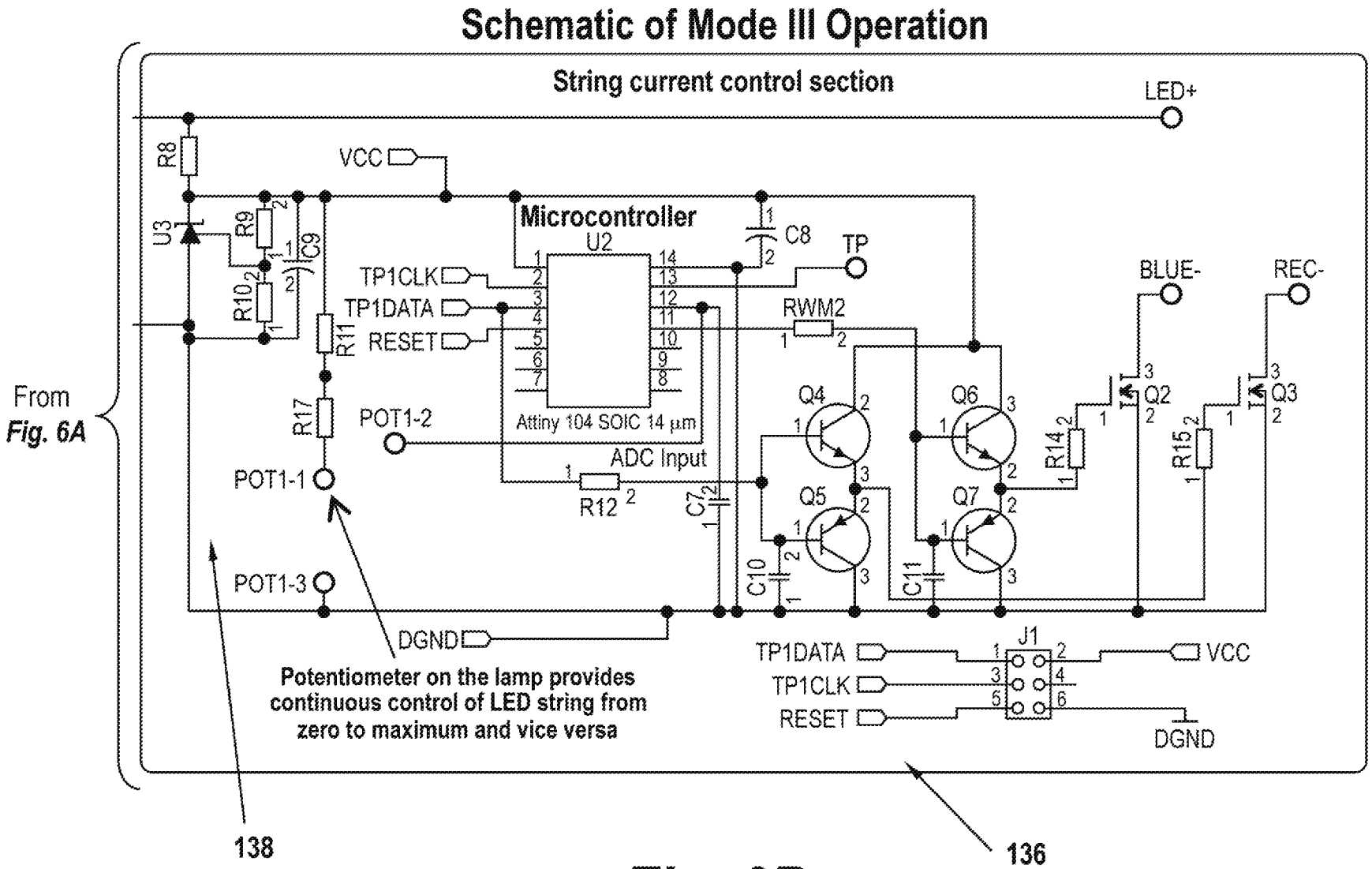

Modes II and III described herein both require the LED String Current Control Section Circuit 134/136 (FIGS. 5 and 6 respectively). The LED string current control section circuits receive supply power and reference voltage from IC U3, R8, R9 and R10. This supply power and reference voltage provides a stable 5V power to the microcontroller U2 and the totem pole MOSFET driver circuit. Potentiometer POT1 138 FIG. 6 along with R11 sets the reference voltage into the microcontroller. This is user input into the lamp that determines the duty cycle of the complementary outputs that drive the LED strings. Bipolar transistors Q4, Q5, Q6 and Q7 form the totem pole driver circuit. R12, R13, C10 and C11 are used to create a small dead time between the PWM outputs to avoid simultaneous conduction of both FETs Q2 and Q3. These MOSFETs are connected to the LED strings and turn them ON and OFF depending on the gate signal to the MOSFETs. J1 is the header for programming of the microcontroller U2.

Mode I Operation

In Mode I operation, the power converter outputs 132 control one string 114/116 of LED's 108 connected to the output. The output current is varied from 50% to 100% based on the potentiometer POT2 138 setting on the lamp 100. For this mode of operation, the microcontroller based string current control section 134/136 is not required.

Figure 7:
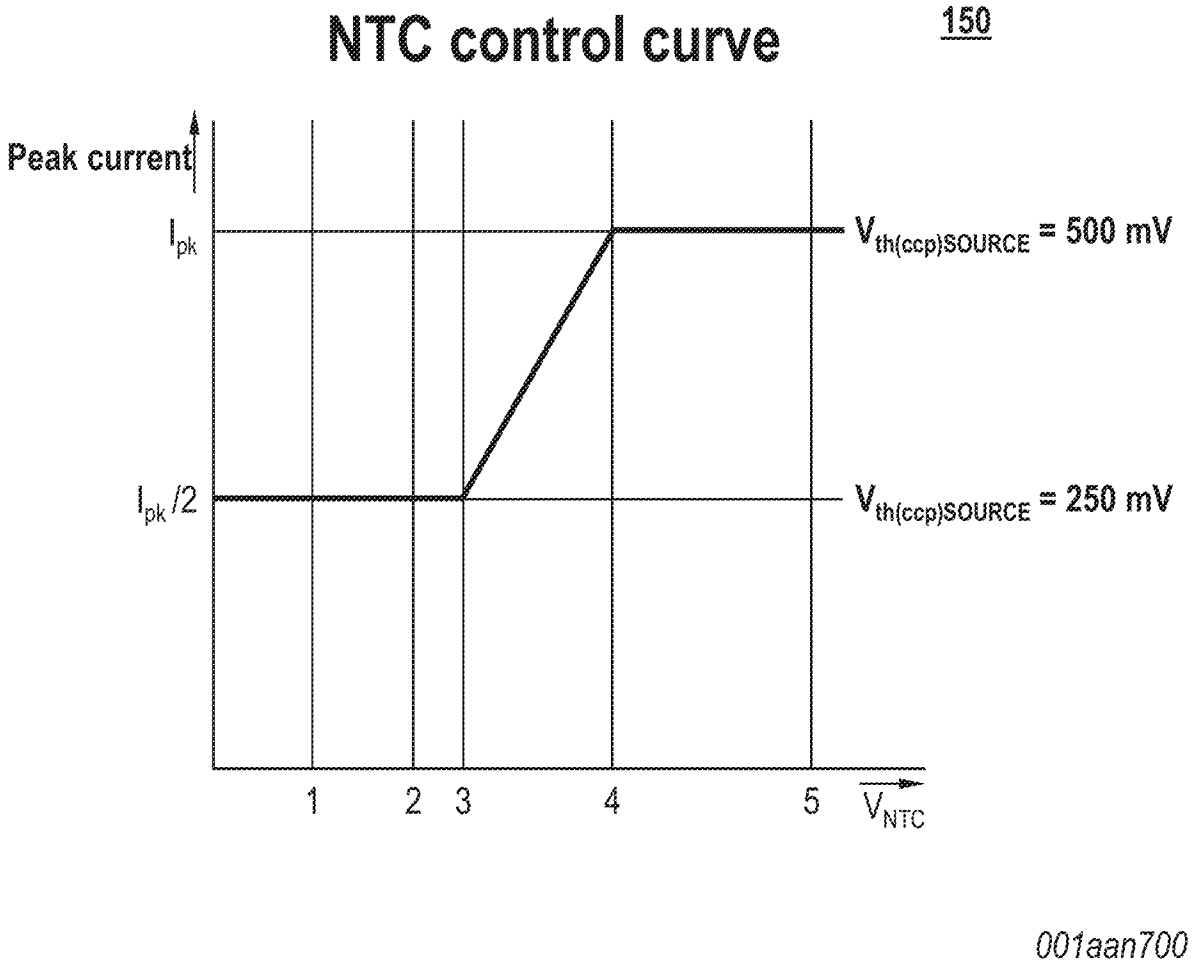
FIG. 7 is a graph illustrating the negative temperature coefficient (NTC) control curve provided by the light-emitting element control circuit operating in accordance with one embodiment of the present invention.

The power converter controller IC SSL2129AT has a NTC (negative temperature coefficient) pin which also can be used for PWM dimming. The pin has an internal current source that generates the current of offset (NTC). An NTC resistor to monitor the LED temperature can be directly connected to the NTC pin. Depending on the resistance value and the corresponding voltage on the NTC pin, the converter reacts as shown in "NTC control curve" 150, FIG. 7. When the potentiometer 138 is fully counterclockwise, the NTC pin threshold is set to Vth (low) NTC, and when the potentiometer is fully clockwise, the NTC pin voltage is set to Vth (high) NTC. When the NTC pin voltage is varied between Vth (low) NTC and Vth (high) NTC levels, the peak current setting of the controller is varied from lpk to lpk/2 in a linear fashion. The lpk setting directly controls the output current. As the lpk setting changes by a factor of two from Vth (low) NTC to Vth (high) NTC level, the output current also changes by a factor of two and thus the 50% to 100% dimming is achieved.

Mode II Operation

This Mode of operation, shown in FIG. 5, requires the "Power Converter section" 130 of FIG. 4 AND the "String current control section" 134 to work together to drive two different LED strings (blue string and red string) connected in parallel. The power converter section 130 generates the right voltage and current required for the LED strings while the string current control section determines which LED string is powered for a given switch setting. The switch 140 on the lamp has 3 positions: one for Red string only, one for Blue string only (with the implicit understanding that this string could have one or more green LEDs in addition to the blue LEDs) and one for operation of both the Red and Blue strings.

This switch 140 is a single pole ON/OFF/ON switch which provides 3 different voltage levels as inputs into the microcontroller based on the 3 positions of the switch. The 3 different levels are achieved by the operation of the switch in conjunction with resistor dividers R11, R16 and R17. The microcontroller is programmed with a voltage threshold window for each position of the switch and by reading the voltage on the ADC pin of the microcontroller, the switch position is identified. If the switch is on the "Red" Setting, MOSFET Q3 will be turned ON and MOSFET Q2 will be OFF so that the Red LED string alone will be powered. If the switch is placed in the "Blue+Green" position, MOSFET Q2 will be turned ON and MOSFET Q3 will be OFF so that the Blue+Green string alone is powered. If the switch is in the "Mix" position, both LED strings will be driven by complementary output of preprogrammed duty cycle. The complementary output ensures that only one LED string is ON at a time. The duty cycle depends on the spectral power distribution that is desired and the ratio of blue to red that is wanted.

Mode III Operation

Like in Mode 11, Mode III requires the "Power Converter section" 130 AND the "String current control section" 136, FIG. 6 to work together to drive two different LED strings (blue string and red string) connected in parallel. Mode III is shown in FIG. 6. The power converter section 130 generates the right voltage and current required for the LED strings 114/116 while the string current control section 136 determines the duty cycle mix of operation of the two LED strings.

When the potentiometer 138 is fully counterclockwise, the Blue+Green LED string is close to 100% duty cycle and the Red LED string is set close to 0% duty cycle. This drives the string of LEDs that has the blue and green LEDs enabling the emission in the blue 400-500 nm region (and the green 500-600 nm region if provided). When the potentiometer 138 is fully clockwise, the Blue+Green LED string is set close to 0% duty cycle and the Red LED string is close to 100% duty cycle. This drives the Red LED string and the spectral emission from the horticultural lamp is now in the 600-700 nm spectrum.

When the potentiometer is rotated clockwise from the fully counterclockwise position, the duty cycle of Red LED string starts to increase from 0% towards 100% while reducing the duty cycle of the Blue+Green LED string from 100% towards 0%. Hence at the two extreme position of the potentiometer, only one string of LEDs will be powered. At all other positions, both LED strings will be powered with a duty cycle as set by the potentiometer position. The microcontroller generates complementary drive output for the two LED strings and hence from an instantaneous perspective, only one LED string is ON at any time. The microcontroller ADC pin reads the analog input voltage coming from the potentiometer. The microcontroller is programmed to linearly change the duty cycle from 0% to 100%. The switching frequency of operation of LED string is also programmed. In this case it is programmed to operate at 333 Hz. The switching frequency of the LED strings can be higher than this level and as high as 10 KHz. However, use of a higher frequency would lead to higher switching losses and a higher EMI signature. On the lower side, we do not want this frequency to be lower than 120 Hz. This is to avoid any possible effect on people who are medically sensitive to light in that frequency region. The authors regard 300 Hz to 1 KHz as an optimum operating frequency region. Small dead time is provided between the two complementary outputs to avoid the potential of driving the two LED strings at the same time.

While the string current control above is carried out by a PWM signal generated by a microcontroller in this embodiment, it is possible to generate the PWM signal using analog circuits too. In either case the same result can be achieved as far as string current control is concerned.

The light emitting element control circuit including an electrical control circuit controller described in this invention disclosure enables the operation of a horticultural lamp in three distinct modes, which allows the user significant flexibility in operation of the lamp. It enables the user to operate the lamp with a fixed emission spectrum but with intensity control (Mode I). It also allows the user to operate the lamp with discrete settings of blue only or red only or a fixed ratio of the two (Mode II). Finally, the invention allows the user to have an on-demand ratio of blue to red emission whereby the user can operate the lamp with any arbitrary ratio of blue to red for example to meet different spectral requirements for different phases of plant growth (Mode III). This improves the yield and quality of the plants and vegetables.

The present invention is not to be restricted or limited to any presented embodiment which is described for exemplary purposes only. Modifications and substitutions by one of ordinary skill in the art are considered to be within the scope of the present invention, which is not to be limited except by the allowed claims and their legal equivalents.

The invention claimed is:

1. A method of controlling a solid state lamp, said solid state lamp having a plurality of light emitting elements, said plurality of light emitting elements including at least a first light emitting element configured for emitting light in a first light spectrum range and at least a second light emitting element configured for emitting light in a second light spectrum range, said method comprising the acts of:

providing a light emitting element control circuit, said light emitting element control circuit configured for electrically controlling at least one of said at least a first light emitting element and said at least a second light emitting element; and said light emitting element control circuit including an electrical control circuit controller, operating under control of appropriate operating instructions stored in said electrical control circuit controller, said electrical control circuit controller responsive to said appropriate operating instructions stored in said electrical control circuit controller and to a user adjustable light emitting element control circuit control device, for selectively controlling one or more of said at least one of said at least a first light emitting element and said at least a second light emitting element according to a position of said user adjustable light emitting element control circuit control device, wherein said light emitting element control circuit controls at least one of: a duty cycle, a voltage and a current, wherein the user adjustable light emitting element control circuit control device is selected from the group of control devices including at least a three position switch and a variable resistor.

2. The method according to claim 1, wherein said at least a first light emitting element includes at least one light emitting element in one of a blue visible light spectrum of between 400 to 500 nm and a green visible light spectrum between 500 and 600 nm, and wherein said at least a second light emitting element includes at least one light emitting element in the red visible light spectrum between 600 and 700 nm.

3. The method according to claim 2, wherein said at least a first light emitting element includes a plurality of light emitting elements connected in series in at least one of said blue visible light spectrum and said green visible light spectrum, and wherein said at least a second light emitting element includes a plurality of light emitting elements connected in series in said red visible light spectrum.

4. The method according to claim 1, wherein the variable resistor is variably adjustable from a fully clockwise position to a fully counterclockwise position.

5. The method according to claim 1, wherein said user adjustable light emitting element control circuit control device is a variable resistor variably adjustable from a fully clockwise position to a fully counterclockwise position, and wherein said light emitting element control circuit controls one of said at least a first light emitting element and said at least a second light emitting element by controlling an amount of one of the voltage and current provided to said one of said at least a first light emitting element and said at least a second light emitting element according to said position of said user adjustable light emitting element control circuit control device.

6. The method according to claim 1, wherein said user adjustable light emitting element control circuit control device is a three position switch, and wherein said light emitting element control circuit controls both said at least a first light emitting element and said at least a second light emitting element by controlling which one of said at least a first light emitting element and said at least a second light emitting element is energized or whether both said at least a first and at least a second light emitting elements are energized based on one of said three positions of said three position user adjustable light emitting element control circuit control device.

7. The method according to claim 1, wherein said user adjustable light emitting element control circuit control device is a variable resistor variably adjustable from a fully clockwise position to a fully counterclockwise position, and wherein said light emitting element control circuit controls both said at least a first light the emitting element and said at least a second light emitting element by controlling a duty cycle of both said at least a first and at least a second light emitting element based on said position of said variable resistor, wherein said light emitting element control circuit is responsive to a fully clockwise position of said variable resistor for providing close to 100% duty cycle of said at least a first light emitting element and for providing close to 0% duty cycle to said at least a second light emitting element, and wherein said light emitting element control circuit is responsive to a fully counterclockwise position of said variable resistor, for providing close to 100% duty cycle of said at least a second light emitting element and for providing close to a 0% duty cycle to said at least a first light emitting element.

8. The method according to claim 1, wherein said user adjustable light emitting element control circuit control device is disposed on an exterior region of said solid state lamp.

9. The method according to claim 1, wherein the solid state lamp further comprises a power supply, wherein the power supply is formed from two distinct circuits involving a power converter section and an LED string current control section and the power supply is configured for allowing the user to control a spectral power distribution of the lamp on demand at any point in an overall plant growth cycle.

10. The method according to claim 9, wherein the power supply is user controllable to cause the lamp to emit a spectral emission that is only in the blue 400-500 nm region.

11. The method according to claim 9, wherein the power supply is user controllable to cause the lamp to emit a spectral emission that is only in the blue-green 400-600 nm region.

12. The method according to claim 9, wherein the power supply is user controllable to cause the lamp to emit a spectral emission that is only in the red 600-700 nm region.

13. The method according to claim 9, wherein the power supply is user controllable to cause the lamp to emit a spectral emission that covers the full 400-700 nm range.

14. The method according to claim 1 further comprising:

controlling a ratio of spectral power emitted by two different LED strings; and adjusting a potentiometer located on a body region of the lamp, such that the duty cycle is adjusted, wherein the ratio of spectral power is controlled by adjusting the duty cycle of an output from a microcontroller.

15. The method according to claim 14, wherein the two different LED strings comprise a first LED string with LEDs emitting in the 600-700 nm region and a second LED string with LEDs emitting in the 400-600 nm blue-green region.

16. The method according to claim 15, wherein the second LED string has LEDs emitting in the 400-500 nm blue region.

17. The method according to claim 14, wherein a dead time is provided between two complementary outputs of the microcontroller to avoid the potential of driving the two LED strings at the same time, wherein the dead time is 50 μs or less.

18. A method of controlling a solid state lamp, said solid state lamp having a plurality of light emitting elements, said plurality of light emitting elements including at least a first light emitting element configured for emitting visible light in a first visible light spectrum range and at least a second light emitting element configured for emitting visible light in a second visible light spectrum range, wherein said at least a first light emitting element includes a plurality of light emitting elements connected in series and configured for emitting visible light in one of a blue visible light spectrum of between 400 to 500 nm and a green visible light spectrum between 500 and 600 nm, and wherein said at least a second light emitting element includes a plurality of light emitting elements connected in series and configured for emitting visible light in the red visible light spectrum between 600 and 700 nm, said method comprising the acts of:

providing a light emitting element control circuit disposed in an interior region of said solid state lamp, said light emitting element control circuit configured for electrically controlling at least one of said at least a first light emitting element and said at least a second light emitting element; and said light emitting element control circuit including an electrical control circuit controller, operating under control of appropriate operating instructions stored in said electrical control circuit controller, said electrical control circuit controller responsive to said appropriate operating instructions stored in said electrical control circuit controller and to a user adjustable light emitting element control circuit control device disposed on an exterior region of said solid state lamp, for selectively controlling one or more of said at least one of said at least a first light emitting element and said at least a second light emitting element according to a position of said user adjustable light emitting element control circuit control device, wherein said light emitting element control circuit controls at least one of: a duty cycle, a voltage and a current provided to at least one of said at least one first light emitting element and at least one second light emitting element, wherein said user adjustable light emitting element control circuit control device is selected from the group of control devices including at least a three position switch and a variable resistor variably adjustable from a fully clockwise position to a fully counterclockwise position.

19. A controller for a solid state lamp, said solid state lamp having a plurality of light emitting elements, said plurality of light emitting elements including at least a first light emitting element configured for emitting light in a first light spectrum range and at least a second light emitting element configured for emitting light in a second light spectrum range, said controller comprising:

a light emitting element control circuit, said light emitting element control circuit configured for electrically controlling at least one of said at least a first light emitting element and said at least a second light emitting element; and said light emitting element control circuit including an electrical control circuit controller, operating under control of appropriate operating instructions stored in said electrical control circuit controller, said electrical control circuit controller responsive to said appropriate operating instructions stored in said electrical control circuit controller and to a user adjustable light emitting element control circuit control device, for selectively controlling one or more of said at least one of said at least a first light emitting element and said at least a second light emitting element according to a position of said user adjustable light emitting element control circuit control device, wherein said light emitting element control circuit controls at least one of: a duty cycle, a voltage and a current provided to at least one of said at least one first light emitting element and at least one second light emitting element, wherein the user adjustable light emitting element control circuit control device is selected from the group of control devices including at least a three position switch and a variable resistor.

20. The solid state lamp controller according to claim 19, wherein said at least a first light emitting element includes at least one light emitting element in one of a blue visible light spectrum of between 400 to 500 nm and a green visible light spectrum between 500 and 600 nm, and wherein said at least a second light emitting element includes at least one light emitting element in the red visible light spectrum between 600 and 700 nm.

21. The solid state lamp controller according to claim 20, wherein said at least a first light emitting element includes a plurality of light emitting elements connected in series in at least one of said blue visible light spectrum and said green visible light spectrum, and wherein said at least a second light emitting element includes a plurality of light emitting elements connected in series in said red visible light spectrum.

22. The solid state lamp controller according to claim 19, wherein the variable resistor is variably adjustable from a fully clockwise position to a fully counterclockwise position.

23. The solid state lamp controller according to claim 19, wherein said user adjustable light emitting element control circuit control device is a variable resistor variably adjustable from a fully clockwise position to a fully counterclockwise position, and wherein said light emitting element control circuit controls one of said at least a first light emitting element and said at least a second light emitting element by controlling and amount of one of the voltage and current provided to said one of said at least a first light emitting element and said at least a second light emitting element according to said position of said user adjustable light emitting element control circuit control device.

24. The solid state lamp controller according to claim 19, wherein said user adjustable light emitting element control circuit control device is a three position switch, and wherein said light emitting element control circuit controls both said at least a first light emitting element and said at least a second light emitting element by controlling which one of said at least a first light emitting element and said at least a second light emitting element energized or whether both said at least a first and at least a second light emitting elements energized based on one of said three positions of said three position user adjustable light emitting element control circuit control device.

25. The solid state lamp controller according to claim 19, wherein said user adjustable light emitting element control circuit control device is a variable resistor variably adjustable from a fully clockwise position to a fully counterclockwise position, and wherein said light emitting element control circuit controls both said at least a first light the emitting element and said at least a second light emitting element by controlling a duty cycle of both said at least a first and at least a second light emitting element based on said position of said variable resistor, wherein said light emitting element control circuit is responsive to a fully clockwise position of said variable resistor for providing close to 100% duty cycle of said at least a first light emitting element and for providing close to 0% duty cycle to said at least a second light emitting element, and wherein said light emitting element control circuit is responsive to a fully counterclockwise position of said variable resistor, for providing close to 100% duty cycle of said at least a second light emitting element and for providing close to a 0% duty cycle to said at least a first light emitting element.

26. The solid state lamp controller according to claim 19, wherein said user adjustable light emitting element control circuit control device is disposed on an exterior region of said solid state lamp.

27. A controller for solid state lamp, said solid state lamp having a plurality of light emitting elements, said plurality of light emitting elements including at least a first light emitting element configured for emitting visible light in a first visible light spectrum range and at least a second light emitting element configured for emitting visible light and a second visible light spectrum range, wherein said at least a first light emitting element includes a plurality of light emitting elements connected in series and configured for emitting visible light in one of a blue visible light spectrum of between 400 to 500 nm and a green visible light spectrum between 500 and 600 nm, and wherein said at least a second light emitting element includes a plurality of light emitting elements connected in series and configured for emitting visible light in the red visible light spectrum between 600 and 700 nm, said controller comprising:

a light emitting element control circuit disposed in an interior region of said solid state lamp, said light emitting element control circuit configured for electrically controlling at least one of said at least a first light emitting element and said at least a second light emitting element; and said light emitting element control circuit including an electrical control circuit controller, operating under control of appropriate operating instructions stored in said electrical control circuit controller, said electrical control circuit controller responsive to said appropriate operating instructions stored in said electrical control circuit controller and to a user adjustable light emitting element control circuit control device disposed on an exterior region of said solid state lamp, for selectively controlling one or more of said at least one of said at least a first light emitting element and said at least a second light emitting element according to a position of said user adjustable light emitting element control circuit control device, wherein said light emitting element control circuit controls at least one of: a duty cycle, a voltage and a current provided to at least one of said at least one first light emitting element and at least one second light emitting element, wherein said user adjustable light emitting element control circuit control device is selected from the group of control devices including at least a three position switch and a variable resistor variably adjustable from a fully clockwise position to a fully counterclockwise position.

* * * * *